United States Patent [19]

Robinson

[11] 3,990,532

[45] Nov. 9, 1976

[54] METHOD AND APPARATUS FOR PROVIDING A CONTROLLED MOVABLE ENVIRONMENT

[76] Inventor: Charles L. Robinson, 23 Bayou Shadows, Houston, Tex. 77024

[22] Filed: Oct. 3, 1974

[21] Appl. No.: 511,804

[52] U.S. Cl. ..... 180/115; 52/2; 52/143; 180/116; 280/12 S

[51] Int. Cl.[2] ..... E04B 1/34; B60V 3/02

[58] Field of Search ..... 52/143, 2; 180/115, 180/116; 280/12 S, 12 K, 29, 30, 32.5; 135/3 A, 4 A

[56] References Cited

UNITED STATES PATENTS

| | | | |
|---|---|---|---|
| 2,099,898 | 11/1937 | Larkin | 280/12 M |
| 2,437,767 | 3/1948 | Thompson | 280/19 |
| 2,744,581 | 5/1956 | Cooper | 52/143 X |
| 2,782,794 | 2/1957 | White | 52/2 |
| 2,906,556 | 9/1959 | Cantele et al. | 296/26 |
| 2,955,606 | 10/1960 | Walker | 52/2 |
| 3,095,616 | 7/1963 | Bigelow, Jr. | 52/143 X |
| 3,109,440 | 11/1963 | Schjeldahl et al. | 52/2 |
| 3,215,218 | 11/1965 | Hurst | 180/115 |

*Primary Examiner*—M. H. Wood, Jr.
*Assistant Examiner*—Milton L. Smith
*Attorney, Agent, or Firm*—Arnold, White & Durkee

[57] ABSTRACT

Method and apparatus for providing a controlled movable environment in accordance with the present invention, for protection of a work area in the environment from adverse external conditions, may take the form of a collapsible and movable building structure that may be moved about in its fully erected condition. The building may include at least one and preferably a plurality of platform devices which may take the form of trailers, self-powered vehicles, sleds or any other suitable motive device having means for engagement with the site on which the building structure is to rest. A lightweight building structure, which may take the form of a flexible inflatable or air supported building structure may be secured to the platform means and may cooperate with the platform means to provide a chamber for protection of the work area and any occupants or equipment for which protection might be desired. Means may be provided for varying the effective weight of the platform means and lightweight building structure to stablize or prepare the same for movement. The effective weight is increased for the purpose of stabilizing the building structure to protect it against the damaging effects of winds, while the effective weight is reduced to a desired minimum in preparation for movement of the building structure. Motive means, such as external towing mechanisms, powered support wheels or the like may be utilized for movement of the platform means and building structure when such movement is desired.

11 Claims, 8 Drawing Figures

106
12
108
104
98
78
100
102
20
58
94
92
86
82
78
84
80
110
114
126
56
20
116
88
90
59
58
64
65
12

METHOD AND APPARATUS FOR PROVIDING A CONTROLLED MOVABLE ENVIRONMENT

FIELD OF THE INVENTION

This invention is directed generally to a protective environment for protection of a work site and the occupants and/or equipment present at the work site from any hostile effects within an atmospheric environment. More specifically, the invention is directed to the provision of a lightweight building structure adapted for provision of a controlled environment for the work site, occupants and equipment, etc. and which building structure may be controllably movable relative to a work site. It may be desirable to provide protective environments for protection of large or small equipment for adverse weather conditions. It may also be desirable to provide protection for large work sites, such as might be involved in the erection of large building structures in areas where weather causes substantial interference, thereby achieving greater efficiency during construction operations.

BACKGROUND OF THE INVENTION

Companies that are in the business of heavy, relatively continuously moving construction operations, such as pipeline construction, roadway construction, and the like historically have been required to function during adverse weather condictions. It is well known that adverse weather conditions such as rain, snow, blowing sand, etc. add to the cost of construction operations and can easily cause severe delays in completion of construction operations. Moreover, many outdoor construction operations, such as pipeline construction, for example, are typically limited to daylight construction operations because it is unfeasible to provide adequate external lighting along right of ways during construction operations. In some cases it is desirable to accelerate progress of the construction work in order to limit the amount of time the workmen are subjected to severe weather conditions and to meet tight construction deadlines. It is therefore desirable to provide a means for substantially limiting the adverse effects of hostile weather environments that might reduce the effectiveness of construction crews and add severely to the cost of construction. It is also desirable to provide means for conveniently extending the working period as long as practical to limit overall construction time. With extended work periods, construction operations might be conducted by alternating crews that keep construction operations functioning from two to three eight hour shifts, effectively reducing the number of days necessary for completion of construction operations.

Where pipelines, roads or the like are being constructed in severly hostile environments, such as extremely cold climates, in tropical areas where rain may reduce the effectiveness of work operations or in the areas where dust or sand storms might severly interfere with construction operations, it is desirable to provide a controlled environment in which workmen may function efficiently and in which construction operations may be conducted regardless of external weather conditions.

Since pipeline construction operations or operations utilized in construction of roadways and the like are continuously moving operations or at least have increments of linear movement as the work progresses, it is desirable to provide a controlled environment that is also movable as the construction operation progresses. It is also desirable that the controlled environment be of sufficient size that construction operations may be carried on without being restricted by the physical size of the controlled environment. Accordingly, it is a primary object of the present invention to provide a controlled environment portection of a work site including equipment and occupants and wherein a controlled environment is movable in its erect or substantially erect condition as construction or other work is extended along an elongated right of way or work site.

It is another object of the present invention to provide a novel controlled environment which may be internally lighted as desired allowing a construction operation to be substantially continuous during all hours of the day.

It is an even further object of the present invention to provide a novel controlled and movable environment that provides the occupants thereof with protection from severe weather conditions, such as extreme cold, heat, dust, rain, snow, sleet, etc. and which will be capable of withstanding high velocity winds, while providing workmen with an acceptable atmosphere in which construction operations may continue unhampered by such weather conditions.

Among the several objects of the present invention is noted the contemplation of a novel lightweight movable building structure that provides a controlled environment for protection of a work site and which includes means for varying the height-to-width ratio of the building structure in order that the stability of the building structure be controlled in accordance with weather conditions.

It is also an important object of the present invention to provide a novel lightweight building structure providing a controlled environment wherein the building structure incorporates means for varying the effective weight of the building structure on the work site, to allow the stability of the building structure to be controlled as desired and to facilitate movement of the building structure when such movement is desired.

It is also an object of the present invention to provide a novel lightweight building structure that is movable and provides a controlled environment for a work site and the occupants thereof and which includes a plurality of ground effect type platforms, trailers or sleds, that may be lifted by air formed thereunder or may be forced to tighter engagement with a work site by the effect of subatmospheric pressure between the platforms, trailers or sleds and the work site, depending upon the effective weight that is desired.

It is an even further object of the present invention to provide a novel lightweight movable building structure that may include ground contacting apparatus that may be elevated by a cushion between the apparatus and the ground for the purpose of movement and which building structure may incorporate one or more keels maintained in engagement with the site that prevent sidewise movement of the building structure during controlled linear movement thereof.

Another object of the present invention contemplates the provision of a novel building structure that is movable and provides the controlled environment for the occupants thereof and which building structure is composed of flexible material and includes accordian folds therein that allow considerable movement of the building structure while traversing undulating terrain without causing the thin flexible material of the building; structure to become overstressed at any localized area.

It is an even further object of the present invention to provide a novel movable lightweight building structure wherein a major portion of the building structure is composed of flexible relatively impervious material and the building structure is maintained in substantially erect condition by superatmospheric pressure contained therein and wherein the extremities of the building structure are strengthened by means of pressure tubes that are maintained at higher pressure than said superatmospheric pressure.

It is also an important object of the present invention to provide a novel lightweight building structure substantially composed of thin flexible sheet material and which building structure incorporates means for preventing loss of the superatmospheric pressure that maintains the building structure in erect condition even while negotiating uneven terrain such as would be defined by ditches and spoil piles along the elongated work site.

It is also an object of the present invention to provide a lightweight building structure within which may be developed a controlled working environment, wherein a major portion of the covering structure of the building may be composed of thin and flexible sheet material which is supported by means of tubular air inflatable support ribs secured to or formed integrally with the sheet material.

Other and further objects, advantages and features of the present invention will become apparent to ones skilled in the art upon consideration of this disclosure. The form of the invention, which will now be described in detail, illustrates the general principles of the invention, but it is to be understood that this detailed description is not to be taken as limiting the scope of the present invention.

SUMMARY OF THE INVENTION

A preferred embodiment of the present invention may conveniently take the form of an inflatable or air supported building structure that is maintained erect by maintenance of a condition of superatmospheric pressure therein or maintained in its erect condition by air inflated tubular structural support ribs. The major portion of the side walls and roof of the building structure may be composed of lightweight relatively air impervious sheet material against which the superatmospheric pressure reacts. Where air pressure differential support is not desired, the sheet material of the side walls and roof portion of the collapsible building structure may be effectively supported by means of tubular air inflated ribs that become sufficiently rigid upon being inflated to provide structural support for the sheet material.

At the lower extremity of the building structure, when air pressure differential support is provided, structure may be provided to maintain a substantial seal between the work site and building structure to allow the development of a ground effect air cushion that has the effect of reducing the effective weight of the building structure and renders it readily movable while maintaining sufficient effective weight to stabilize the building structure and prevent it from moving responsive to high velocity wind. A motive means is provided for imparting movement to the building structure when movement is desired and such motive may be external or self contained as desired.

A number of movable supports, such as platforms, trailers, or sleds may be provided that may be connected in linear manner on either side of the building structure, which movable supports are of sufficient weight for maintenance of the total perimeter of the building structure in close proximity to the work site. The movable supports may also be transporting devices for fuel and equipment for the various work operations that may be conducted within the controlled environment and additionally may transport air flowing devices that serve to force air into the building structure and maintain the superatmospheric pressure condition required for stability of the same. Additionally, the air blowing devices may be capable of directing air into a chamber defined beneath the sled devices when the movement of the sled devices is desired, thereby creating a cushion of air for at least partial support of the sled devices to reduce the effective weight thereof and enable motive means to move the entire building structure. The air blowing devices may also be utilized in such manner as to develop a subatmospheric pressure condition within a chamber beneath the sled devices, thereby creating holddown forces that serve to increase the effective weight of the sled devices and improve the resistance of the entire lightweight building structure to the effects of high winds. The air blowing devices may also be equipped with heat exchanger mechanisms for providing either cool or warm air for the environment within the building structure as desired. Filters for removing particulate material such as sand and dust may also be incorporated into the air blowing devices.

To prevent the platforms, trailers or sleds from drifting sideways under the influence of wind or because of the slope of the terrain on which the building structure rests, while the platforms, trailers or sleds are maintained in the reduced weight condition thereof by the ground effect cushion of air, one or more keels, runners or other site contacting devices may be provided that will be in contact with the work site at all times and will effectively resist undesirable drifting of the building structure. Movement of the building structre is thereby directionally controlled. The keels, runners or other drift preventing devices may be formed integral with the sled structures or may be adjustably carried thereby as desired.

To facilitate traverse of undulating terrain, the inflatable building structure may be provided with a plurality of sections having accordian like folds that enable the materials from which the building structure is composed to have substantial movement without developing any local stresses that might have an adverse effect on the building structure.

The lightweight building structure of the present invention may comprise flexible side wallls and a roof that may be composed of lightweight sheet material, the sheet material being supported in the erect condition of the structure by a plurality of spaced rib elements. The supporting rib elements may conveniently take the form of tubular elements composed of sheet material which may be rigidified by air pressure.

Because of the necessity for entry to and exit from the building structure while it is maintained in erect condition, the extremities of the buildings may be provided with rather stiff flexible sections defining openings, which rather stiff sections may be provided by a plurality of pressure tube elements that are maintained at higher air pressure than the air pressure necessary for maintaining the building structure in its erect condition. The doors of the building structure may be defined as flaps as having holding devices such as magnets that maintain the flaps in a closed condition to prevent leakage of air from the building structure when closure of the flaps is desired. The flaps may be flexible and may accommodate uneven terrain in the area of the work site such as might be defined by a ditch, a spoil pile or the like, as is typically the case when pipelines and roads are being constructed.

To assist in stabilizing the building structure against sidewise drift at all times but especially when the platform, trailer or sled devices are partially supported by the ground effect cushion of air developed by the air blower systems to facilitate movement of the building structure, each of the plateforms or sleds may be provided with one or more low pressure large foot print wheels such as are typically utilized on marsh buggies and other soft terrain vehicles. The wheels serve to control the direction of travel of the building structure and to facilitate at least partial support of the building structure while movement of the building structure is underway. Motor devices, such as electric motors, hydraulic motors, and the like may be utilized in connection with the support wheels to provide self contained motive means for the building structure if desired. In the alternative, external towing devices such as conventional tractors may be connected to the leading sleds or at intervals between sleds or trailers for towing of the building structure. The towing operation may be conducted either with or without the benefit of effective weight reduction by ground effect air cushion support, as desired.

BRIEF DESCRIPTION OF THE DRAWINGS

So that the manner in which the recited features, advantages and objects of the present invention as well as others, which will become apparent, are obtained and can be understood in detail, more particular description of the invention, briefly summarized above, may be had by reference to the embodiments thereof which are illustrated in the appended drawings, which drawings form a part of this specification.

It is to be noted, however, that the appended drawings illustrate only a few of numerous types of lightweight movable building structures that are made possible by employment of the method and apparatus set forth herein and the embodiments illustrated in the drawings are not to be considered limiting the scope of the invention, for the invention may admit to other equally effective embodiments without departing from the spirit and the scope of this invention.

In the Drawings:

Figure 1:
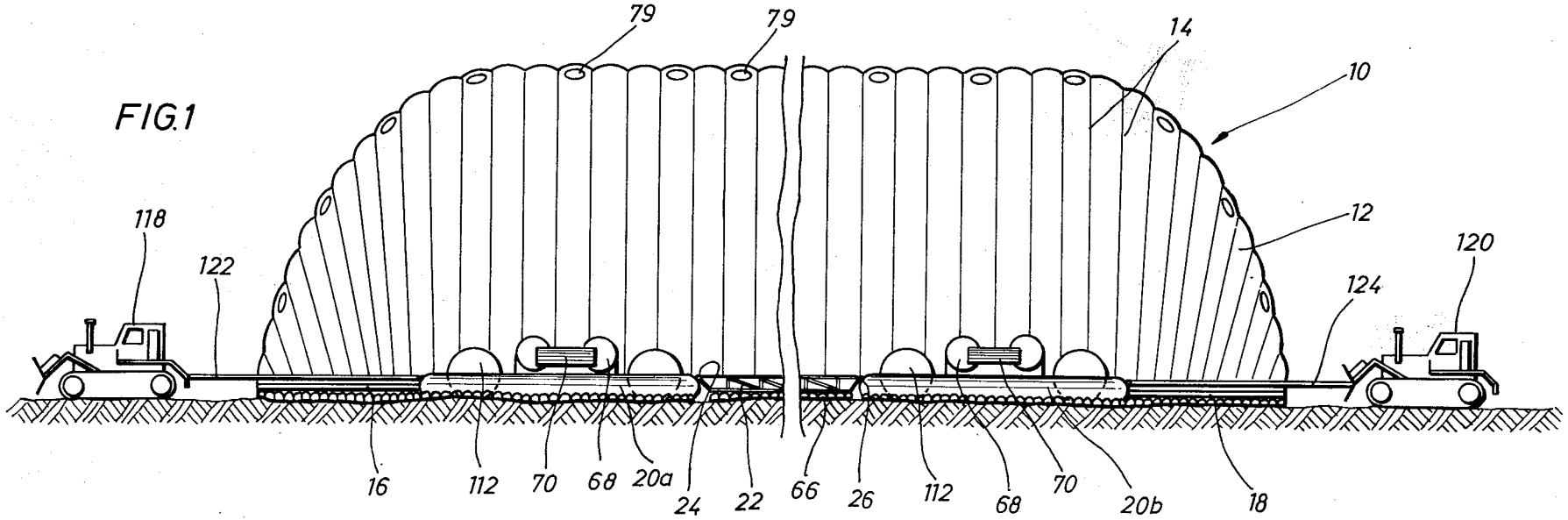

FIG. 1 is a pictorial representation in section of a lightweight movable air pressure differential supported building structure constructed in accordance with the present invention and illustrating the building structure being controllably moved by means of tractors connecting to the sled, trailer or platform mechanisms of the building structures. The left hand portion of FIG. 1 illustrates the provision of air supported tubular support ribs, which form a modified embodiment of this invention.

Figure 2:
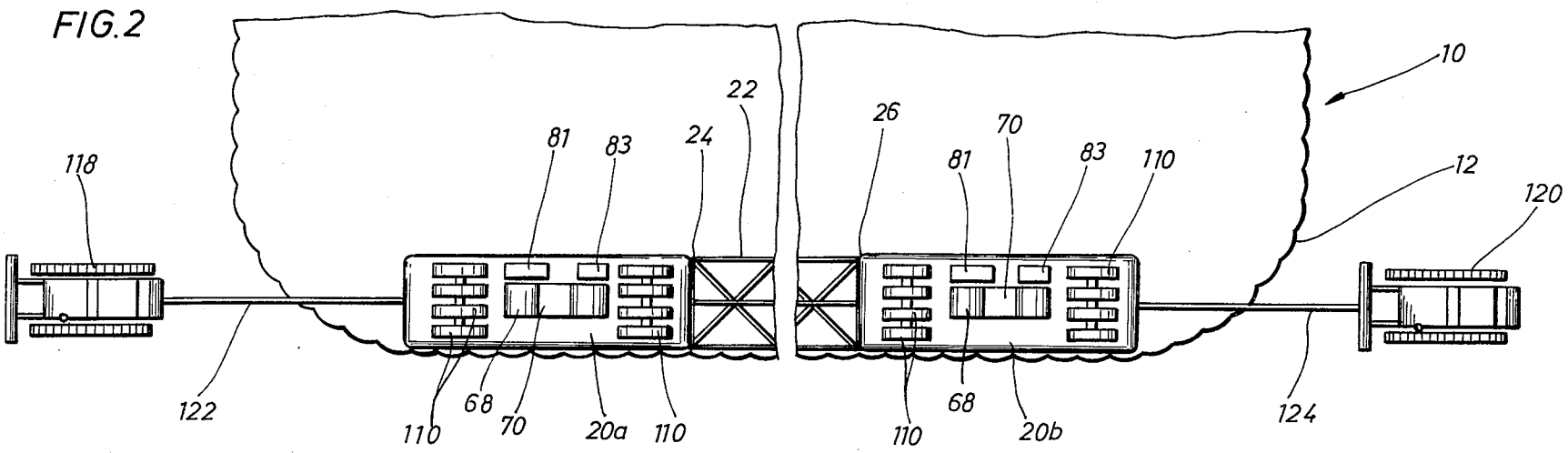

FIG. 2 is a partial plan view of the building structure of FIG. 1 illustrating the relationship of the sled, trailer or platform devices to the building structure and also illustrating tractor type towing mechanisms that are connected to the building structure for movement for the same.

Figure 3:
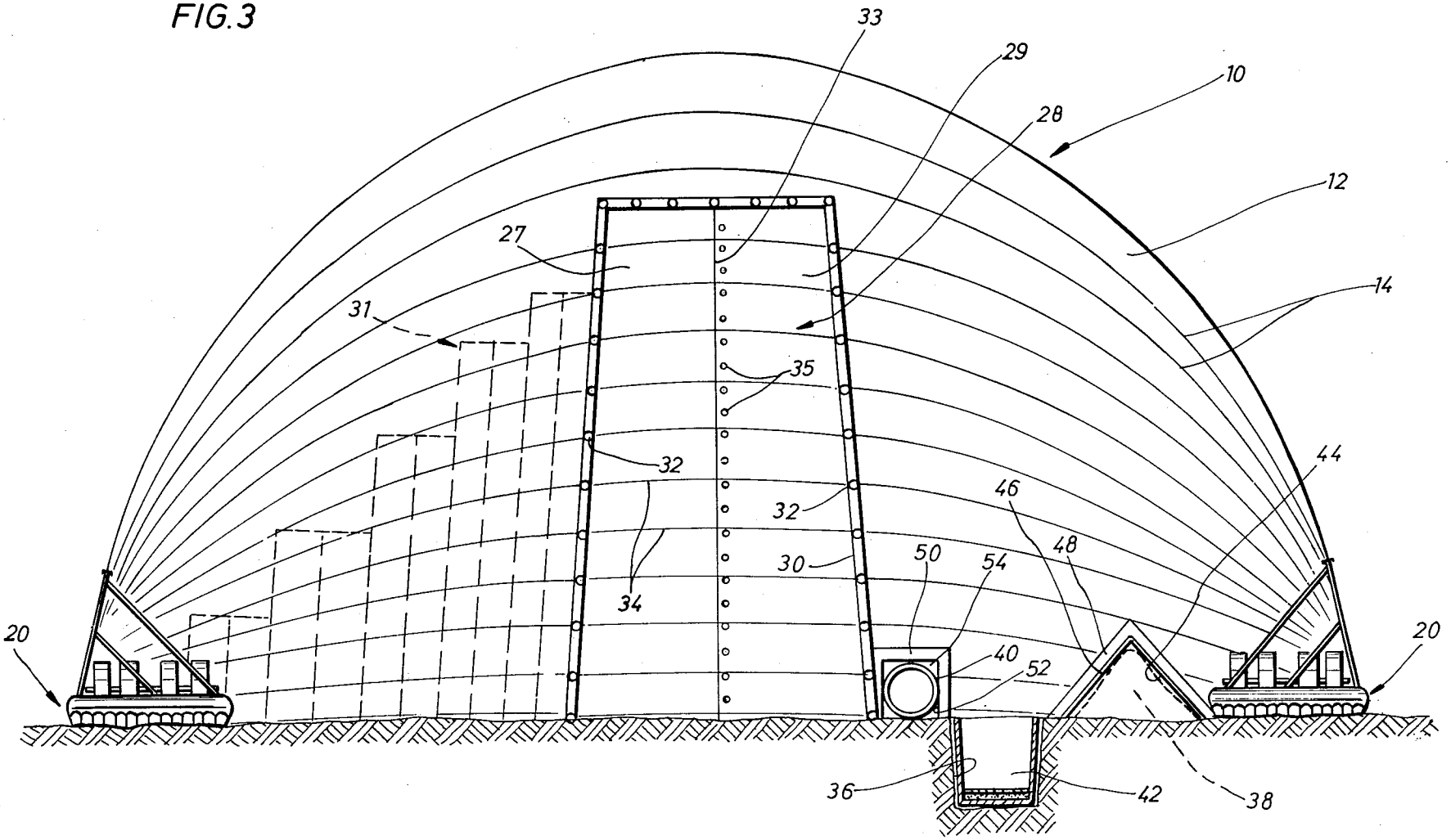

FIG. 3 is an end elevational view of the light-weight movable building structure depicting an end view configuration such as might be employed in building structures specifically designed for use in connection with construction of pipe lines.

Figure 4:
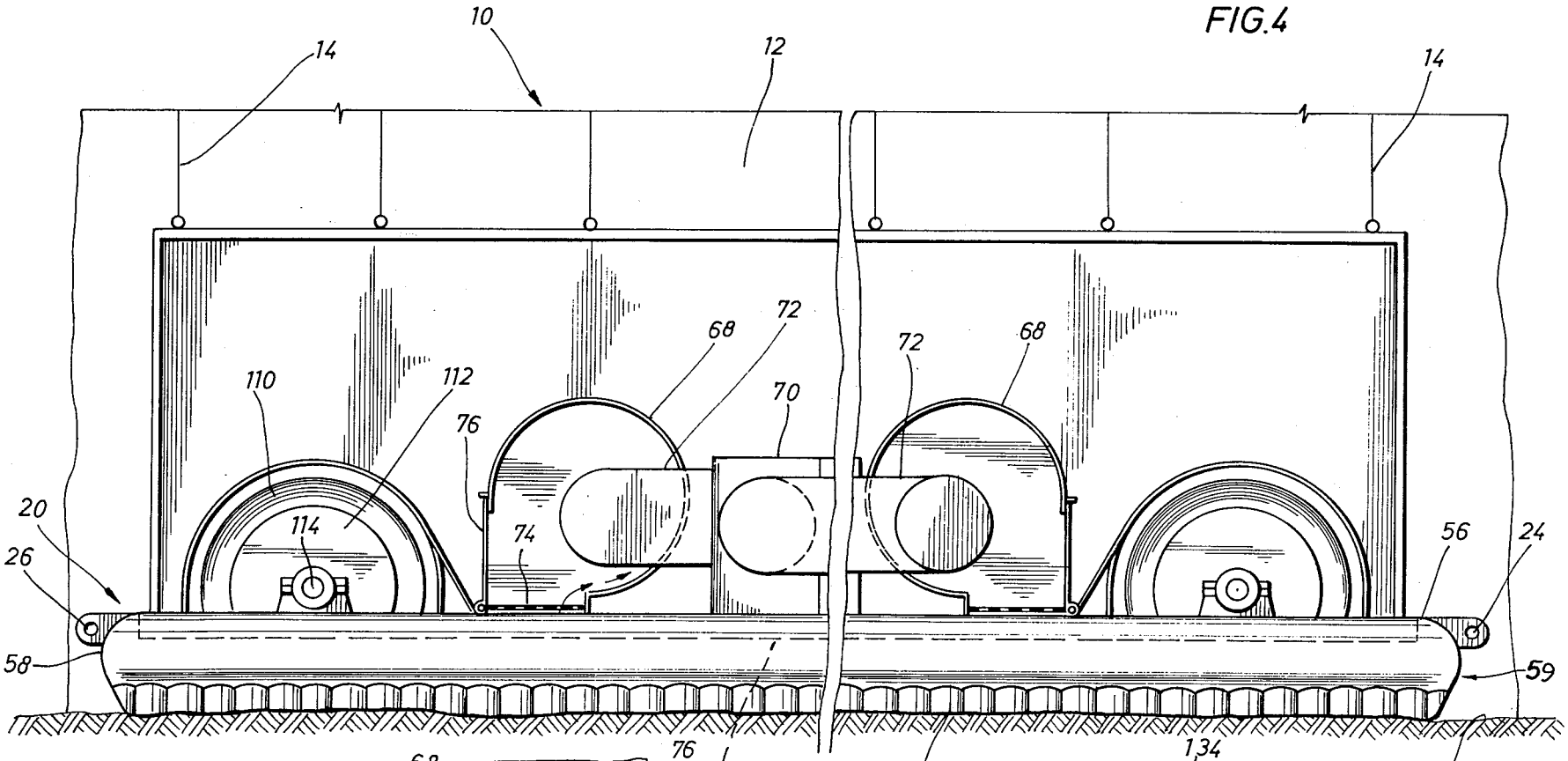

FIG. 4 is a fragmentary side elevational view of a portion of the building structure of FIG. 1, illustrating one of the platform, trailer or sled devices that may be utilized in combination with the building structure.

Figures 5, 6:
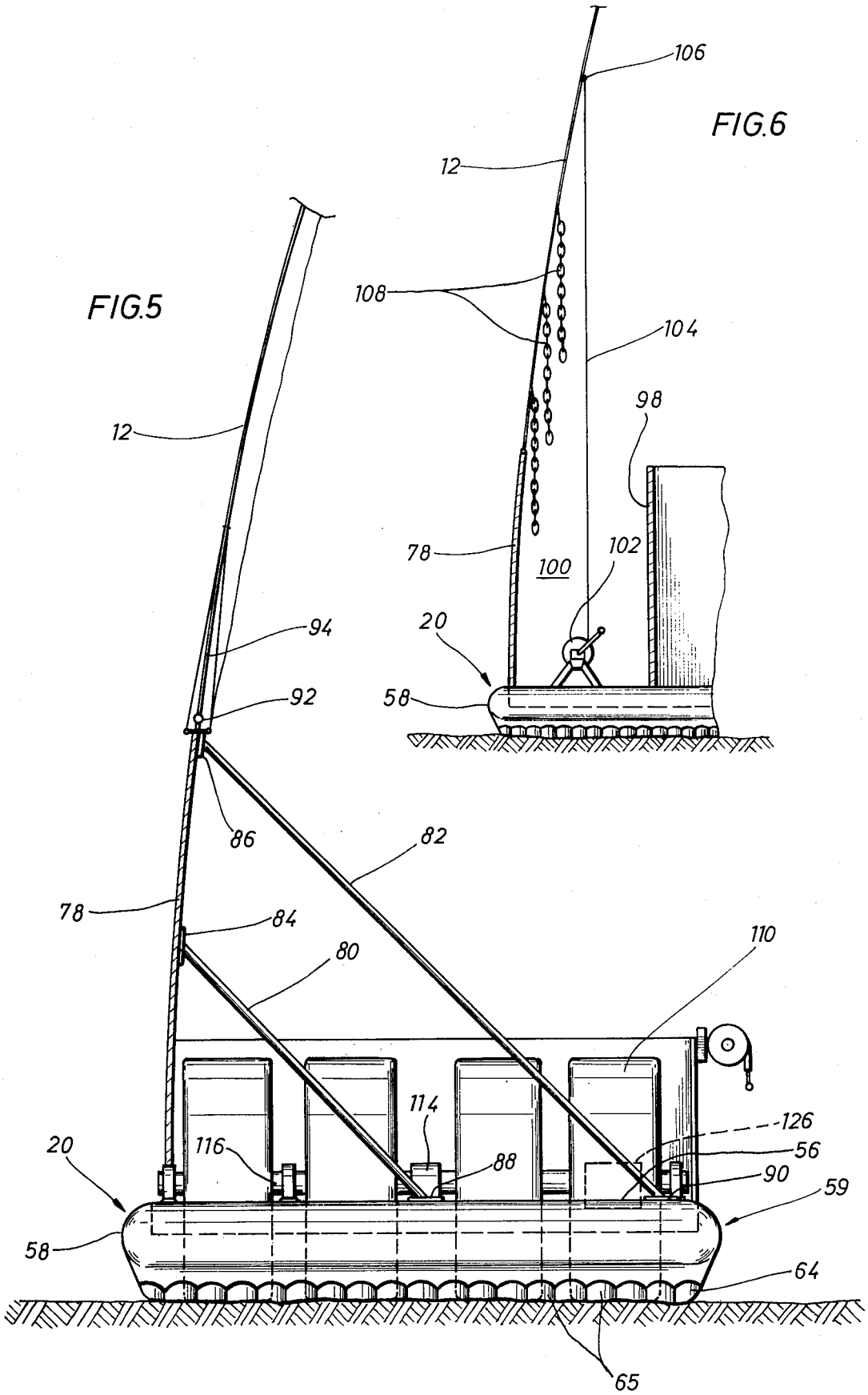

FIG. 5 is a fragmentary sectional view of a portion of the building structure constructed in accordance with the present invention illustrating a portion of the wall structure of the building in detail.

FIG. 6 is a fragmentary sectional view of a building structure constructed in accordance with the present invention, depicting a portion of the wall structure of the building in detail, illustrating means for effectively reducing the height-to-width ratio of the flexible inflatable portion of the building structure and further depicting a receptacle for containing loose folds of sheet material that develop as the height of the building structure is reduced and for directing the loose folds to enter the receptacle for protective storage.

Figure 7:
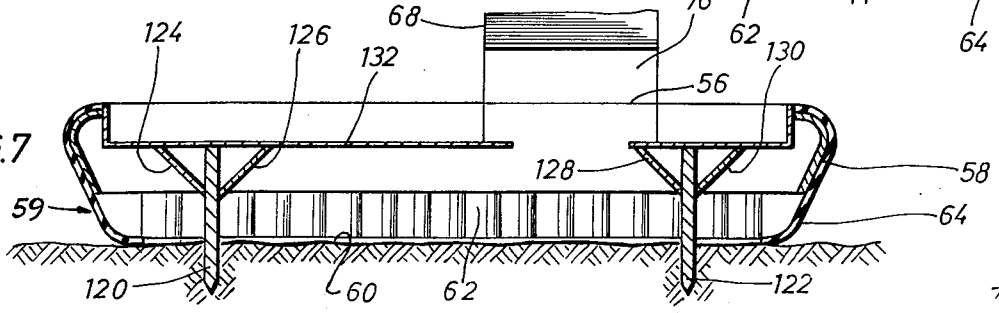

FIG. 7 is a sectional view illustrating the lower portion of a sled or platform structure representing a modified embodiment of the present invention, depicting ground engaging keels that may be employed instead of or in addition to wheel structures for preventing lateral movement of the sled structure at all times but especially when the effective weight of the sled structure is reduced responsive to the presence of a ground effect cushion of air.

Figure 8:
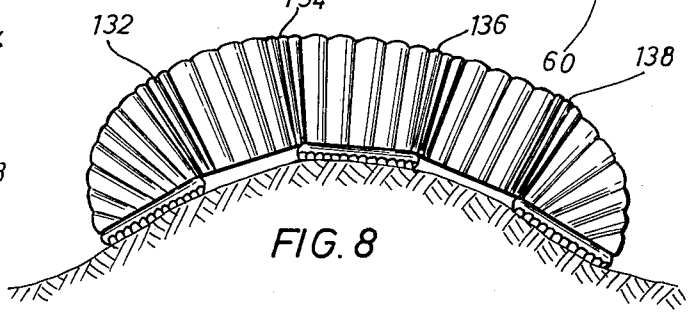

FIG. 8 is an elevational pictorial representation of an inflatable building structure constructed in accordance with the present invention and representing a modified embodiment, which is specifically designed to prevent overstressing of the thin flexible sheet material of the building structure as the building structure is moved relative to undulating terrain.

DESCRIPTION OF THE PREFERRED EMBODIMENTS

Although a lightweight movable building structure in accordance with the present invention may take many other suitable forms as explained above, for the purpose of simplicity, the building structure of the present invention is illustrated and discussed as it might apply in connection with construction of pipelines, roadways and the like. Also, it is not intended in any way to limit the size and configuration of the building structure, it being obvious that building structures in accordance with the present invention may take many different forms and sizes without departing from the spirit and scope of this invention. For example, such building structures may be of sufficiently small size to cover or protect any type of vehicle or personnel activity outdoors ranging from the smallest vehicle which will transport one person or the smallest practical piece or industrial or commercial equipment to the moderately large range which might provide protection for several dozen pieces of industrial equipment commonly utilized in construction, repair, inspection or operation of pipelines and or roads.

It is also within the concept of this invention to provide extremely large movable building structures for construction or other operations related to extremely large structures and for moving the erected building structures from place to place while erected or inflated in accordance with the fundamental concept of the present invention. For example, the present basic concepts may be employed for utilization of an inflatable building structure and for moving the same while still inflated over and covering many dozens or hundreds of acres or even several square miles such as an area wherein an entire subdivision of a city might be under construction, then permitting uninterrupted construction operations as well as other desirable operations to continue to progress in adjacent areas by simply moving the inflated building structure as construction continues.

At least two basic concepts of accomplishing movement of an inflated building structure will be evident as detail discussion of the present invention continues and each of these particular methods may be suited to different type situations or environments. Extensions and/or combinations of these two basic methods are rendered available in accordance with the scope of the present invention. The first method may involve erecting the building structures in segments, each segment except the first being initially inflated in part within the confines of another fully erected building structure and then gradually moving the newly completed segment out of the erected building structure while under partially inflated conditions. After complete removal from the erected building structure, the building structure can be fully erected and connected to the previous completed building structure as desired. This procedure, as will be more fully explained hereinbelow, avoids the very major difficulty of attempting to erect an inflatable building under windy conditions, which conditions render erection of inflatable buildings very difficult, dangerous and in some cases practically impossible.

The second general method for achieving movement of an inflated or erected building structure may be accomplished by moving the inflated building in a desired direction while maintaining the building structure fully inflated and pressurized, wherein the moving operations includes means for controllably moving hold-down weight devices that are essential to any inflatable building in order to prevent it from being blown out of control by external winds and/or by the action of the superatmospheric pressure utilized to maintain the building in erect condition. In accordance with this method, the inflated building could be moved forward or backward either continuously or at intervals as required for efficient utilization of personnel and equipment working in the protective environment provided by the building structure. Furthermore, the terrain itself may be protected from adverse weather such as rainstorms, snow storms, and the like which can severely hamper construction operations as are typically accomplished out of doors. While either of the above general methods of erection and movement of portable building structures may be suited to a particular requirement or situation, it will be seen from the detailed description set forth below that these general methods when properly implemented will be of great usefulness to all types of outdoor commercial or industrial activity. The present invention may be employed effectively with either of these two general methods.

Referring now to the drawings and first to FIG. 1, there is depicted a movable lightweight building structure, illustrated generally at 10, having a wall structure 12 composed of relatively air impervious thin flexible material such as the plastic sealed or rubberized fabric material and which wall structure is maintained in a suitable controlled configuration by a plurality of restraining elements 14 that may conveniently take the form of cables, ropes, strong fabric tapes and the like that may be connected to the fabric material in any desired manner. The extremities of the restraining devices 14 may be suitably connected to support devices that cause the building structure to be retained in the desired erect condition thereof regardless of the external forces to which the structure is subjected, such as the force developed on the building structure by wind, for example. Part of the support devices located at the extremities of the building structure may be defined by rather rigid end support structures 16 and 18 that may in turn be supported by the end ones of the plurality of sleds, trailers or platform devices such as shown at 20*a* and 20*b*. In the vicinity of the platform devices the restraining devices 14 may be secured directly to connecting elements provided on the platform devices.

Between each of the platform devices 20*a* and 20*b* may be provided a connecting element 22 which connecting element may be in the form of a rigid framework simply serving as a rigid spacer between the platform devices. Pivot means such as shown at 24 and 26 may provide the connection between the extremities of the framework and the individual platform devices and may allow articulation between the rigid framework and each of the platform devices facilitating traverse of undulating terrain. The spacer framework may also be provided with an air-cushion type skirt similar to that provided on the platforms, if additional lift or hold-down force is desired.

With reference to FIG. 3, an end view of a lightweight movable building structure designed particularly for utilization in connection with construction with pipelines may take the form shown, wherein doors may be provided for entry and exit of construction equipment. These doors may take the form of air locks to minimize air loss. For example, one of the particular pieces of construction equipment typically utilized in connection with construction of pipelines is a side boom tractor which employs a rather tall support boom structure that functions in connection with lifting and transporting of pipe. It is obvious that side boom tractors carrying sections of pipe will be required to transport pipe from a pipe storage facility to the vicinity of the pipeline being constructed and will need to enter and exit the portable building structure. To facilitate such operations the building structure will be provided with a rather large door opening 28 of considerable height. The frame for this door may be composed of the same air impervious flexible material from which the flexible portion of the building structure is formed, but the material may be constructed in tubular form. Air may be retained within the tubular form of the framework 30 at sufficiently higher pressure as compared to the superatmospheric pressure contained within the building structure, to maintain the framework structure of the door in substantially rigid condition. The restraining devices extending to the vicinity of the door 28 may be secured to connectors 32 and restraint connector devices 34 may also be secured to the connectors 32 in order to maintain the structural integrity of the building structure while the door is closed. The restraining devices 34 may be disconnected when it is desired to open the doorway for entry or exit of construction equipment. It has also been envisioned that provision of a rather rigid complete end wall structure of the inflated building can eliminate the necessity for providing additional removable restraining elements, such as those shown at 34. In this case, substantially all of the end wall structure of the flexible building may be composed of tubular elements that are maintained at substantially higher pressure than the internal pressure of the building. For example, the internal pressure maintaining the building structure in an erect condition may be in the order of a few ounces in excess of atmospheric pressure while pressure within the tubular elements defining the end wall structure may be in the order of 5 to 30 psi.

The door opening 28 may be provided with a pair of closure flap elements 27 and 29 that are also composed of flexible air impervious material and which may be held together in any suitable fashion to prevent leakage of air through the doorway. For example, the doorway opening 33 may be provided with a plurality of magnetic elements 35 that engage ferrous metal members on the opposite flap structure in order to provide a substantial seal between the two flaps. When entry of equipment through the doorway is desired, it is simply necessary to provide a force that is sufficiently great to overcome the magnetic attraction of the magnetic elements 35 to the ferrous metal elements. In the alternative, each of the flaps 27 and 29 may be provided with strips of material that adhere to one another tightly when brought into contact. One example of such material is that sold under the registered trademark VELCRO.

In the construction of a pipeline a trench or ditch such as shown at 36 is typically formed by conventional ditching equipment and formation of the ditch typically results in the formation of an elongated spoil pile such as shown at 38. It is desirable that the building structure be capable of negotiating the ditch and spoil pile without allowing excess amounts of air to be exhausted therefrom. Additionally, it is desirable that the building structure be capable of negotiating pipe such as shown at 40 that might be disposed adjacent the ditch 36. Accordingly the building structure may be provided with a flap element 42 that extends downwardly into the ditch 36 and functions to provide a seal to prevent air from being exhausted from the ditch structure. The flap 42 may be composed of any suitable flexible material, but it must have good wear characteristics because it is dragged along the wall structure of the ditch as the building is moved. A rather heavy but flexible rubberized fabric material will function quite efficiently to define the flap 42.

The building structure may also be constructed with a generally triangular opening, such as shown in 44, that is of a size and shape to receive the spoil pile 38. Within the opening 44 may be provided a quantity of loose material 46, defining a sealing element that engages the spoil pile and prevents unnecessary leakage of air through the triangular opening 44. Additionally, an air inflated tubular structure 48 may be employed to reinforce the building structure in the vicinity of the opening 44 to prevent any localized portion of the building structure from being excessively stressed. A similar tubular reinforcing element 50 may be employed to receive the pipe 40 within a generally rectangular opening 52. The opening 52 may also be lined with a quantity of flexible material 54 that is adapted to fit rather closely about the pipe and provide a seal to prevent excessive leakage of air. It may also be necessarry to prevent leakage through the pipe and this can be accomplished simply by placing any suitable sealing element over the upstream extremity of the pipe, thereby causing the air pressure within the building structure to maintain the sealing element in sealed engagement with the pipe. While particular structure has been shown for the building structure that has been designed for utilization in connection with construction of pipelines, other building structures having other end designs may be employed within the spirit and scope of the present invention.

When utilizing lightweight air supported building structures or air tube supported building structures it is necessary to provide sufficient "hold-down" weight that will prevent the building from moving undesirably responsive to internal and external forces, such as the force of air pressure within the building or the force developed by wind. The amount of hold-down weight required is quite large because it is necessary to counteract the lifting force of the pressure differential internally and externally of the building structure, which lifting force can be as much as 2000 to 4000 pounds per 10 feet of length in a building structure having a width in the order of 100 feet. For a building structure 1000 feet in length for example, holddown weights of 300,000 to 400,000 pounds may be required on each side of the building structure to overcome the lifting force developed by the pressure differential. The effective weight of the building structure is even more critical when considering movement of the building, because it may be necessary to reduce the effective weight of the building structure substantially while accomplishing such movement. Moreover, it will be typical for the building to yield under circumstances where wind is blowing and it will be necessary to maintain the building in a sufficiently rigidly inflated condition to withstand the forces of winds, which may be in the order of 50 miles per hour or greater.

It is considered appropriate therefore to provide hold-down forces that may be adjusted in accordance with the activity that is involved with the building structure and one suitable means of achieving controlled variation of the hold-down forces may conveniently take the form illustrated in the drawings and shown particularly in FIGS. 4 and 5 where each of the sleds or platforms 20*a*and 20*b* may be constructed to be at least partially supported by a ground effect cushion of air provided in a chamber between the sled or platform mechanism and the surface of the site on which the platform rests. The cushion of air may be controlled in such a manner that it will reduce the effective weight of the platform to any sufficient degree, thereby allowing the platform to be readily movable along with portions of the building structure. Each of the sleds or platforms may be in the order of 30 to 50 feet in length and between 4 to 10 feet in width and may be composed of steel or other strong and heavy material. The platform or sled structure, together with any apparatus mounted thereon, such as electrical generator equipment, batteries, inflation fans and other mechanisms for control of the environment within the building structure, may constitute the normal hold-down weight, but the effective weight of the platform or sled mechanisms may be controlled in the manner discussed hereinbelow.

As shown in FIGS. 4 and 5 as well as in other figures of the drawings, each of the sled or platform structures, illustrated generally at 20, may include a rather rigid base structure 56 that may be secured in any suitable manner to the balloon and skirt portion 58 of a ground effect lifting structure shown generally at 59. A skirt 64 is provided on the balloon portion 58 and is composed of a plurality of adjacent flexible fingers that cooperate to provide an effective air seal. The balloon and skirt portion define a generally rectangular shell having a cavity beneath the shell that cooperates with the surface 60 of the site to define a chamber 62 within which may be contained a cushion of air. Contact of the flexible skirt 64 with the ground surface will cause the skirt to be folded inwardly, such as shown in FIG. 7, maintaining substantially sealed contact with the ground and preventing the cushion of air from completely escaping from beneath the sled or platform structure. There will, of course, be allowed limited leakage of flowing air from beneath the ground effect structure as effective weight reduction of the building structure is taking place.

The flexible skirt 64 may be composed of any durable flexible material such as rather heavy natural or synthetic rubber material that may be reinforced with any suitable fabric. The flexible skirt 64 may be composed of many individual segments 65 that are secured to the lower extremity of the balloon portion 58 of the platform and which individual segments cooperate with adjacent segments to define a cooperative flexible structure that resists flow of air through the skirt portion. It may also be desirable to provide the support frame structure 22 shown in FIGS. 1 and 2 with a ground effect weight control system including a flexible skirt portion such as shown at 66 in FIG. 1 and 2. In this case, the sides and top of the support frame structures are closed defining an exclosure into which compressed air may be forced to define an air cushion between the frame element and the surface of the work site. The frame element, so constructed, will also provide a function of increasing the effective weight of the building structure when a condition of subatmospheric pressure is maintained thereunder.

In order to force compressed air beneath the sled structures, one or more blower devices such as shown at 68 may be provided on each of the platform, trailer or sled structures, which blower devices may be arranged to suck air from the atmosphere outside the portable building structure and to direct the flow of air as desired. Each of the blowers may be powered by a motor mechanism 70 through means of conventional belting that may be closed by safety enclosures 72. The motor mechanism 70 may be of variable speed and power in order to develop air pressure as required both for substaining erection of the building structure and for directing high velocity air flow beneath the sled structures that develops sufficient lift to reduce the effective weight of the sled structure as is desired for movement of the building structure.

For the purpose of controlling the flow of air generated by the blowers or fans 68, the discharge opening 74 of each fan will be directed downwardly through the deck of the base portion 56 causing air to flow downwardly as the motor 70 is driving the fan mechanism. Air being directed beneath the sled structure will provide a cushion of air that will provide a lifting force that reduces the effective weight of the sled structure. Each of the fan housings may be provided with a valve element 76 that may allow air developed by the fan structure to be exhausted into the building, developing sufficient superatmospheric pressure within the building structure to maintain it in a stable condition. When the sole purpose of the flow of air generated by the fans is to maintain the building structure in a substantially rigid condition, it is not necessary for all of the fans of all of the sleds to be employed at any one time. For example, in a building 500 feet in length there may be provided 10 or more sled structures, each having a pair of motorized blowers provided therefor. Utilizing blowers at each extremity of the building can provide sufficient air fow to maintain superatmospheric pressure to prevent collapse of the building. When it is desired to move the building structure relative to the work site, most of the blower mechanisms may be activated with the valves 76 thereof maintained in the closed position in order to provide sufficient lifting function without overinflating the building and stretching or bursting the material from which the building is composed. Also, if desired, the door flaps 27 and 29 may be opened and other suitable vent devices may be opened to allow exhaust of air and prevent overinflation of the building structure.

Although air may be forced beneath the platform, trailer or sled structures to reduce the effective weight thereof, there may develop circumstances where it is desirable to increase the effective weight of the sled structures beyond that which is ordinarily required for stability of the movable building structure. For example, in the event extremely high winds are encountered in the area of the work site, it may be desirable to increase the hold-down forces acting upon the building structure to prevent it from becoming damaged. In accordance with the present invention, increasing the effective weight of the sled structures may be accomplished by reversing the direction of the blower motor 70, thereby reversing the direction of the blowers 68 and causing the blowers to partially evacuate the chamber 62 disposed below the sled structures. When a suction is created by the fans or blowers 68 in the chamber 62, atmospheric pressure acts upon the base portion of the sled structure thereby developing the desired additional hold-down force.

It may also be desirable to compensate for externally applied forces such as wind forces by reducing the height-to-width ratio of building structure and, in effect, streamlining the building so it will have less resistance to blowing wind. As shown in FIGS. 5 and 6, a relatively rigid wall structure 78 may be secured to each of the sled structures; perhaps also to each of the rigid connector framework structures such as shown at 22 in FIGS. 1 and 2, which wall structure extends to a particular level above the sled structures. Angle braces such as shown at 80 and 82 may be received by connectors 84 and 86, respectively, provided on the wall structure 78 and by connectors 88 and 90 provided on the sled structure to retain the wall structure 78 in erect and stabilized position. Connector elements 92 may be provided at the upper extremities of each of the wall structures and connector elements, such as shown at 94, may be employed to secure the flexible material 12 to the upper extremity of the wall structure. Additionally, the flexible walls of the building structure may be doubled and separately inflated if desired to provide a trapped air space for the purpose of insulation in the event the building structure is to be used under severely cold conditions as might be found in the Artic.

In the event it is not desirable to support the lightweight flexible building structure by means of air pressure differential it may be desirable to provide rib means that have the effect of providing effective support for the sheet material from which a major portion of the wall and roof portion of the building is constructed. In accordance with the present invention, tubular air inflated rib elements may be employed such as shown at 79 in FIG. 1, the rib elements 79 may be composed of the same air impervious material from which the wall and roof portions of the building are composed. The air pressure within the rib elements may be in the order of 5 to 30 psi as desired to provide sufficient structural integrity to adequately support the sheet material of the building structure.

The sled, trailer or platform structures may be provided with electrical and hydraulic power generating mechanisms, such as shown at 81 and 83, respectively, that provide power for the various work operations being conducted within the controlled environment. For example, the electrical power generator mechanism may be capable of generating electrical power that may be utilized for welding operations, for lighting the interior of the building structure, providing electrically energized heating, cooling, etc. The hydraulic power source may also be utilized for various work operations that are conducted within the building. An air supply system may also be provided for generating high pressure air for various work operations that are energized by high pressure air, such as operation of air hammers and drills, for example. The various power generating mechanisms may be provided with conventional retractable cords and hoses that are capable of reaching all of the areas within the building structure.

As shown in FIG. 6, wall structure 98 may be carried by each of the sled structures and may cooperate with the external wall structure 78 to define a receptacle 100 within which loose folds of the sheet material may descend when the height of the building structure is reduced. The sled structures may also include a winch mechanism 102 having a cable 104 or other connecting device received by connectors 106 provided on the flexible wall structure 12 of the building. When it is desired to reduce the overall height or to reduce the height and width of the building, such as is desirable when the building is moved through a narrow passage, the winch mechanisms are manipulated either manually or by powered winch apparatus as desired, thereby moving the connector 106 and the wall structure of the enclosure downwardly toward the winch. When this occurs, loose folds will occur in the wall material below the connector elements 106 and, to prevent damage to these loose folds of material, the receptacle 100 is provided as a receiver that serves a dual function of retaining and providing protection for the loose folds of material. A plurality of weights, such as shown at 108, may also be connected to the wall structure of the building and may assist in movement of the loose folds of material downwardly into the receptacle 100. When strong winds are encountered, the walls of the enclosure may be winched downwardly, thereby reducing the overall height of the structure and providing a more efficient streamlined and stabilized structure that can better resist the forces of high winds.

It may also be desirable to provide means for facilitating movement and support of the sled or platform structures and to insure against sidewise movement of the platform structures during forward movement. In accordance with the present invention such means may conveniently take the form of a plurality of relatively large wide foot print low pressure tires 110 carried by wheels 112 that are rotatably supported by journals 114 carried by the sled structure. The journals receive an axle 116 upon which the wheel structures 112 are rotatably secured. After the effective weight of the sled structure has been reduced by application of a ground effect cushion of air by the air supply fans or blowers 68, the tires 110 will remain in contact with the work site and will provide a guiding and rolling function of facilitate movement of the building structure as desired. As shown in FIGS. 1 and 2, a plurality of towing tractors 118 and 120 may be secured by towing connectors 122 and 124, respectively, to the sleds defining the leading and trailing extremities of the building structure. With the effective weight of the building structures substantially reduced by the ground effect cushions beneath the sled structures and perhaps also beneath the connector frame structures 22, the tractor towing devices 118 and 120 will easily be able to move a building structure of perhaps 1000 or more feet in length. The leading tractor 118 may provide a towing function while the trailing tractor structure 120 may provide sufficient braking to prevent unnecessary overrunning or crowding of the sled devices as the building structure is moved. Under certain circumstances, the tractor mechanism 120 may also be utilized to apply a pushing force on the rear most sled device to assist its movement. Tractors or other motive devices may also be employed to move intermediate sleds of the building.

Movement of the building structure may also be accomplished by providing the support wheels 112 with means for achieving a driving function. If desired, electric motors, hydraulic motors or any other suitable motor mechanisms may be drivingly interconnected with the wheel structures in such a manner as to achieve a driving function. The wheel motors may be powered by generator equipment or hydraulic supply equipment carried by the individual sled devices. If it is desired to provide the individual support wheels with motors for achieving a driving function, the motors 126 may be provided for one, two or more of the eight wheels of each sled device within the spirit and scope of the present invention. It is not deemed necessary to provide each of the support wheels with a drive motor unless the forces encountered during movement of the building structure are sufficient to warrant the same.

Although support wheels, such as those shown in the various figures of the drawings, are deemed appropriate for controlling movement of the building structure, such wheels are not deemed mandatory. It is envisioned that sled or platform structures may be provided such as illustrated in FIG. 7, having no wheels but being provided in the alternative with a plurality of keels or runners that maintain continuous engagement with the work site regardless of the particular vertical position of the sled relative to the work site. As shown in section, the flexible sealing elements 64 may be turned inwardly against the ground surface 60 of the site, thereby providing a seal against the ground structure, which retains a ground effect cushion of air within the chamber 62 and, depending upon the pressure of air within the chamber 62 provides a lifting function that serves to reduce the effective weight of the sled structure. The flexible skirt assembly set forth in other figures of the drawings will function similarly as shown in FIG. 7 when the chamber 62 is maintained under low pressure.

When it is desired to reduce the effective weight of the sled structure, air pressure within the chamber 62 will be increased and the sled structure will move upwardly slightly with respect to the surface 60 of the work site. When this occurs the flexible skirt 64 will straighten but at least a portion of it will remain in slight air flow restricting contact with the surface 60 of the work site. To prevent wind and terrain from imparting undesired movement to the sled structure, the sled may be provided with at least one and preferably a pluralitiy of keels such as illustrated at 120 and 122 that extend below the maximum level of the flexible skirt and maintain engagement with the work site at all times. The penetrating relationship between the keels and the work site provides sufficient lateral restraint to prevent the sled from sliding sidewise in the event the building structure is subjected to severe wind forces. The rails do not materially hamper linear movement of the sleds as the building is towed in linear manner. In fact, the keels 120 and 122 serve a guiding function to cause precise tracking of the sleds as the building structure is towed in linear manner. Brace elements 124, 126, 128 and 130 may interconnect the respective keels and the deck portion 132 of the sled structure, thereby providing sufficient structural integrity to prevent damage to the sled structure as large side loads are applied to the keel structures.

When a building structure of the nature set forth herein traverses undulating terrain, it is possible for the lightweight, thin, air impervious material from which it is composed to be overstressed in points thereby causing the material to tear. Accordingly, in the present invention excessive localized stressing may be effectively overcome in the manner illustrated in FIG. 8 wherein the building structure may be provided with stress relief bands such as illustrated at 132, 134, 136 and 138 where additional material is retained between closely spaced restraining devices which allow considerable movement of the material before any portion of the thin wall structure of the building can become overstressed.

The electrical generators on the trailers can provide power for electrical welding, eliminating the need for separate generators, lowering cost of reducing air pollution within the building. Electrical power "drop-cords" may be suspended from the roof of the inflatable building at intervals. "Drop cords" can be "coil spring wound" to retract out of the way when not required.

In view of the foregoing, it is apparent that I have provided a novel controlled environment for protection of occupants from any hostile effects of the atmospheric environment and which controlled environment may be simply and efficiently moved along a work site allowing continuously movable construction operations to be carried on in a continuous manner or at selected time intervals within the building structure in absence of the conditions that might otherwise result if such operations were carried on outdoors. The present invention facilitates construction operations that may be continuous both day and night because internal lighting may be provided within the building structure as desired. Moreover, ordinary weather conditions such as rain, snow, sleet, cold temperatures, windstorms, and the like will not prevent the construction operations from continuing unhampered, thereby promoting efficiency of the construction operation and allowing such operations to be completed in a minimum amount of time.

I have provided means for controlling the effective weight of sled or platform devices through utilization of blowing air that either provides an air cushion or a condition of suction beneath such platform devices as is desired for enhancing the stability of the building structure or lightening the building structure in order for it to be efficiently moved. I have also provided means for externally controlling movement of the building structure and, if desired have provided self-driving apparatus for the building structure as a realistic alternative. Additionally, my invention provides means for controllably moving a building structure and yet preventing undesirable sidewise movement that might otherwise occur responsive to the forces of wind or terrain. In addition, I have provided means for insuring that the lightweight flexible sheet material from which the building structure is composed will not become damaged due to localized overstressing as a building structure is moved along undulating terrain.

My invention also promotes utilization of lightweight inflatable type building structures in areas where severe wind storms may be encountered. My invention includes a provision of means for effectively modifying the height-to-width ratio of inflatable building structures in order to render such structures less susceptible to damage by the forces of wind.

It is therefore apparent that the present invention is one well adapted to attain all of the objects and advantages hereinabove set forth, together with other advantages which will become obvious and inherent from a description of the apparatus and method utilized in accordance with the teachings of the present invention. It will be understood that certain combinations and subcombinations are of utility and may be employed with reference to other features and subcombinations. This is contemplated by and is within the scope of the present invention. As many possible embodiments may be made of this invention without departing from the spirit or the scope thereof, it is to be understood that all matters hereinabove set forth or shown in the accompanying drawings are to be interpreted as illustrative and not in a limiting sense.

Having thus fully described may invention in detail, I claim:

1. A controlled environment for protection of a work area from any hostile effects of the atmospheric environment, said controlled environment being movable to selected positions along a moving work site and comprising:

platform means having site engaging means;

a lightweight building structure being attached to said platform means and providing a protective enclosure, said enclosure substantially containing said controlled environment, said lightweight building structure being formed of a thin flexible material maintained in erect condition responsive to maintenance of a superatmospheric pressure condition therein;

air supply means provided for in said controlled environment for maintaining a regulated super-atmospheric pressure within said lightweight building structure at all times, said super-atmospheric pressure being controllably regulatable for stabilization of said building structure relative to the wind velocity at said work site;

motive means being provided for said platform means and causing desired movement of said platform means and said lightweight building structure relative to said moving work site; and means for controllably adjusting the height-to-width ratio of said lightweight building structure.

2. A controlled environment as recited in claim 1, wherein said means for controllably adjusting the height to width ratio of said lightweight building structure comprises:

connector means establishing connection between said platform means and said flexible material at a level above said platform means, said connector means being adjustable to selectively position said connection between said connector means and said desired position relative to said platform means.

3. A controlled environment as recited in claim 2, wherein said environment includes:

a material retention receptacle being disposed in close proximity to said flexible material and receiving loose folds of said flexible material as said connector means is adjusted to move said connection and a portion of said material toward said platform means.

4. A controlled environment as recited in claim 3, wherein said environment includes:

means being connected to said flexible material below the level of said connection to said connector means and said flexible material and controllably moving loose folds of said material into said receptacle means as said connector means is adjusted to move said connection and a portion of said material toward said platform means.

5. A controlled environment as recited in claim 3, wherein:

said lightweight building structure is formed with reinforced wall means, said opening frame means being defined in said reinforced wall means; and said opening frame means being defined by a plurality of inflatable structural elements being maintained at higher pressure than the pressure within said lightweight building structure.

6. A controlled environment as recited in claim 5, wherein:

said air supply means is controllable for selectively maintaining a superatmospheric pressure condition within said building, maintaining a subatmospheric pressure condition between said platform means and said work site, maintaining a ground effect cushion of flowing air between said platform means and said work site and establishing a pressure condition within said opening frame means.

7. A controlled environment as recited in claim 1 wherein:

said platform means includes elongated platforms located at the sides of said lightweight building structure and arranged to move in linear manner relative to said site;

means establishing a substantial seal between said platforms and the surface of said site and defining an air chamber between said platforms and the surface of said site; and said air supply means controllable for selectively forcing a cushion of air between said platforms and the surface of said site to cause reduction in the effective weight of said platforms to prepare said environment for movement and selectively creating a suction within said chamber to increase the effective weight of said platforms and enhance the stability of said lightweight building structure.

8. A method of providing a controlled environment in which a construction, inspection or repair operation may be conducted and which controlled environment may be moved relative to a work site, said method comprising:

a providing platform means that is capable of resting upon the surface of said work site;

providing a lightweight collapsible building structure that is supported by said platform means and in which building structure said operation may take place;

erecting said lightweight collapsible building structure;

moving said platform means and said lightweight building structure along the surface of said work site to a desired location;

modifying the height-to-width ratio of said lightweight building structure to increase the stability of said building structure, to provide an adequately high ceiling for working operations and to allow passage of said building structure through work sites that are more narrow than the normal width of said building structure;

said lightweight building structure being composed of thin and flexible sheet material for permitting adjustment of the height of the building structure relative to the platform contained within the structure by extending and retracting wall portions of the sheet material; and adjusting the spacing of the platform means disposed in spaced relation within the building structure.

9. A method of providing a controlled environment in which a construction, inspection or repair operation may be conducted and which controlled environment may be moved along a moving work site, said method comprising:

providing platform means that is capable of resting upon the surface adjacent said moving work site;

providing a lightweight collapsible building structure that is supported by said platform means and in which building structure said operation may take place;

erecting said lightweight collapsible building structure;

moving said platform means and said lightweight building structure along the surface as said work site also moves along the surface;

modifying the height-to-width ratio of said lightweight building structure to increase the stability of said building structure, to provide an adequately high ceiling for working operations and to allow passage of said building structure through work sites that are more narrow than the normal width of said building structure which structure is composed of thin and flexible sheet material and said platform means includes platforms disposed in spaced relation;

adjusting the height of said building structure relative to said platform means by extending and retracting wall portions of said sheet material; and adjusting the spacing of said platform means.

10. A controlled environment for protection of a work area from any hostile effects of the atmospheric environment, said controlled environment being movable to selected positions along a moving work site and comprising:

platform means having site engaging means;

a lightweight building structure being attached to said platform means and providing a protective enclosure, said enclosure substantially containing said controlled environment, said lightweight building structure being formed of a thin flexible material maintained in erect condition responsive to maintenance of a superatmospheric pressure condition therein;

air supply means provided for in said controlled environment for maintaining a regulated super-atmospheric pressure within said lightweight building structure at all times, said super-atmospheric pressure being controllably regulatable for stabilization of said building structure relative to the wind velocity at said work site;

motive means being provided for said platform means and causing desired movement of said platform means and said lightweight building structure relative to said moving work site; and wherein flap means is provided on said lightweight building structure, said flap means engaging deformities in the work site and conforming to objects resting upon the site and maintaining a substantial seal therewith to prevent leakage of large volumes of air from said lightweight building structure.

11. A method of providing a controlled environment in which a construction, inspection or repair operation may be conducted and which controlled environment may be moved along a moving work site, said method comprising:

providing platform means that is capable of resting upon the surface adjacent said moving work site;

providing a lightweight collapsible building structure that is supported by said platform means and in which building structure said operation may take place;

erecting said lightweight collapsible building structure;

moving said platform means and said lightweight building structure along the surface as said work site also moves along the surface;

modifying the effective weight of said platform means to control the stability of said building structure, said effective weight being determined responsive to forces tending to impart undesirable movement to said building structure; and wherein the effective weight of said platform means is varied by controllably altering the pressure conditions within said building structure.

* * * * *

UNITED STATES PATENT AND TRADEMARK OFFICE

CERTIFICATE OF CORRECTION

PATENT NO. : 3,990,532

DATED : November 9, 1976

INVENTOR(S) : Charles L. Robinson

It is certified that error appears in the above–identified patent and that said Letters Patent are hereby corrected as shown below:

Col. 1, line 17, "for" should read --from--;
Col. 1, line 29, "condictions" should read --conditions--;
Col. 2, line 8, "portection" should read --protection--;
Col. 4, line 43, "structre" should read --structure--;
Col. 4, line 56, "wallls" should read --walls--;
Col. 5, line 17, "plateforms" should read --platforms--;
Col. 6, line 60, "piece or" should read --piece of--;
Col. 14, line 8, "of" should read --to--;
Col. 16, line 37, "with" should read --without--;
Col. 17, line 28, "to" should read --of--.

Signed and Sealed this

Eleventh Day of January 1977

[SEAL]

*Attest:*

RUTH C. MASON
*Attesting Officer*

C. MARSHALL DANN
*Commissioner of Patents and Trademarks*